United States Patent [19]

DeMusis

[11] 3,969,848

[45] July 20, 1976

[54] TURBINE BLADE AIR SEAL EDGE GRINDER

[76] Inventor: Ralph T. DeMusis, 1 Commercial St., Branford, Conn. 06405

[22] Filed: May 5, 1975

[21] Appl. No.: 574,564

[52] U.S. Cl. ..... 51/141; 51/143

[51] Int. Cl.[2] ..... B24B 21/08

[58] Field of Search ..... 51/135 R, 141, 143, 51/82 R, 98 R, 128

[56] References Cited

UNITED STATES PATENTS

| | | | |
|---|---|---|---|
| 1,178,400 | 4/1916 | Jones | 51/82 R |
| 1,282,022 | 10/1918 | Baker | 51/98 R |
| 2,562,229 | 7/1951 | Bell | 51/141 |
| 2,728,364 | 12/1955 | Muehling | 51/128 X |
| 2,751,723 | 6/1956 | Lindmark | 51/135 R |
| 2,934,864 | 5/1960 | Karbowski | 51/141 |

*Primary Examiner*—Al Lawrence Smith
*Assistant Examiner*—Nicholas P. Godici
*Attorney, Agent, or Firm*—H. Gibner Lehmann; K. Gibner Lehmann

[57] ABSTRACT

A machine for refinishing edge portions of air seal flanges on the ends of turbine blades, comprising a bench or base, an abrasive belt carried by multiple pulleys mounted on the base, means for driving the belt, a contoured shoe carried by the base at a work-performing station thereon, and a slide movable over an upper surface of the base toward and away from the work-performing station, the slide being adapted to carry the turbine blade being refinished. Means are provided on the slide for releasably clamping the blade in a position such that the air seal flange thereof is movable toward and away from the cutting surface of the abrasive belt. The contoured shoe is disposed in a position wherein it backs up the belt at its point of contact with the air seal flange. In addition, adjustable stop means are provided on the base for limiting the advancing movement of the slide (and turbine blade) toward the belt, wherein the operator merely urges the slide slowly in one direction until the stop means become operative. Such an arrangement limits the amount of material which is ground from the air seal flange, and thus imparts a predetermined desired contour thereto. In addition, indicator means are provided, carried by the base, for enabling periodic measurements to be made of the remaining flange dimension. As a result, greatly improved resurfacing characteristics are realized, as well as a high degree of repeatability from one unit to another.

10 Claims, 4 Drawing Figures

10
12
16
17
18
20
30
32
37
39
40
42
44
45
46
48
50
52
54
56
60
61
64
66
68
70
74
76
78
80
82
85
90
92
94
96
100
102
106
108
109
114
116
120
122
124
126
130

TURBINE BLADE AIR SEAL EDGE GRINDER

CROSS REFERENCES TO RELATED APPLICATIONS

Copending application entitled "Turbine Blade Air Seal, Side Grinder" in the name of Ralph T. DeMusis, U.S. Ser. No. 574,563, filed May 5, 1975.

Copending application entitled "Method and Means for Repairing Turbine Vanes" in the name of Ralph T. DeMusis, U.S. Ser. No. 528,839, filed Dec. 2, 1974.

BACKGROUND

This invention relates generally to turbine blade resurfacing machines, and more particularly to machines adapted to impart a particular predetermined finish contour to air seal portions of a turbine blade.

Generally, turbine blades are constituted of high-temperature, high-strength alloy especially adapted to withstand the temperatures and stresses imposed on the parts of a turbine assembly. In the past, repair of such turbine blades has been sufficiently complex and expensive as to make it impractical to undertake such operations on a large scale. Instead, when the blades have become worn, they were discarded, with new blades substituted in their place. Due to the fact that such blades are cast, they tended to be very expensive, and the replacement of entire units has resulted in a costly operation.

Part of the problem with resurfacing blades was that the tolerances involved tended to be rather critical. In addition, it was extremely difficult to closely duplicate the original surfaces on a worn piece. In some instances, welded material was applied to the worn area, after which the bulk or excess was removed by grinding or polishing. In such operations, duplication of the original surfaces has been found to be extremely difficult to achieve.

SUMMARY

The above disadvantages and drawbacks of prior procedures and devices are obviated by the present invention, which provides a novel and improved machine for refinishing the end edges of air seal flanges of turbine blades. The present machine comprises a bench or base, a circulating abrasive belt carried by the base together with means for driving the belt, a contoured backing shoe affixed to the base at a work-performing station thereon, a slide movable over the base toward and away from the shoe at the work-performing station, and means carried by the slide for releasably clamping a turbine blade thereto with the end seal flanges disposed toward the work-performing station. Additionally, adjustable stop means are provided on the base for limiting the advancing movements of the slide toward the belt. The arrangement is such that (the movement of) the slide advances the turbine blade into engagement with the abrasive belt at the areas thereof which are backed up by the contoured shoe. The amount of advance is limited by the stop means. By such an arrangement, predetermined portions of the seal flange are removed, corresponding to the desired dimensions and surface contours thereof. In addition, indicator means are provided on the base for periodically checking the amount of material on the seal flange which has been ground off by the abrasive belt. With the present machine, an operator can quickly and accurately impart a particular surface configuration to the seal flange, and check the dimensions of the finished flange with a minimum of time and effort. In addition, the repeatability of the contour between successive blades is extremely good. As a result, overall error due to judgement by the operator is greatly minimized.

Accordingly the invention has for an object the provision of a novel and improved machine for refinishing the end edges of air seal flanges, which is extremely simple in its construction, reliable in operation, and capable of providing closely controlled contours to used turbine blades that have had their worn surfaces built up, as by welding. Another object of the invention is the provision of an improved machine as above, wherein errors due to judgement by the operator are greatly minimized. Still another object is the provision of a refinishing machine which enables quick and easy periodic checking of the amount of welding material which has been ground off, without the necessity of removing the blade from the area of the work-performing station on the base.

Still other features and advantages will hereinafter appear.

In drawings, showing a preferred embodiment of the invention:

Figures 1, 3, 4:
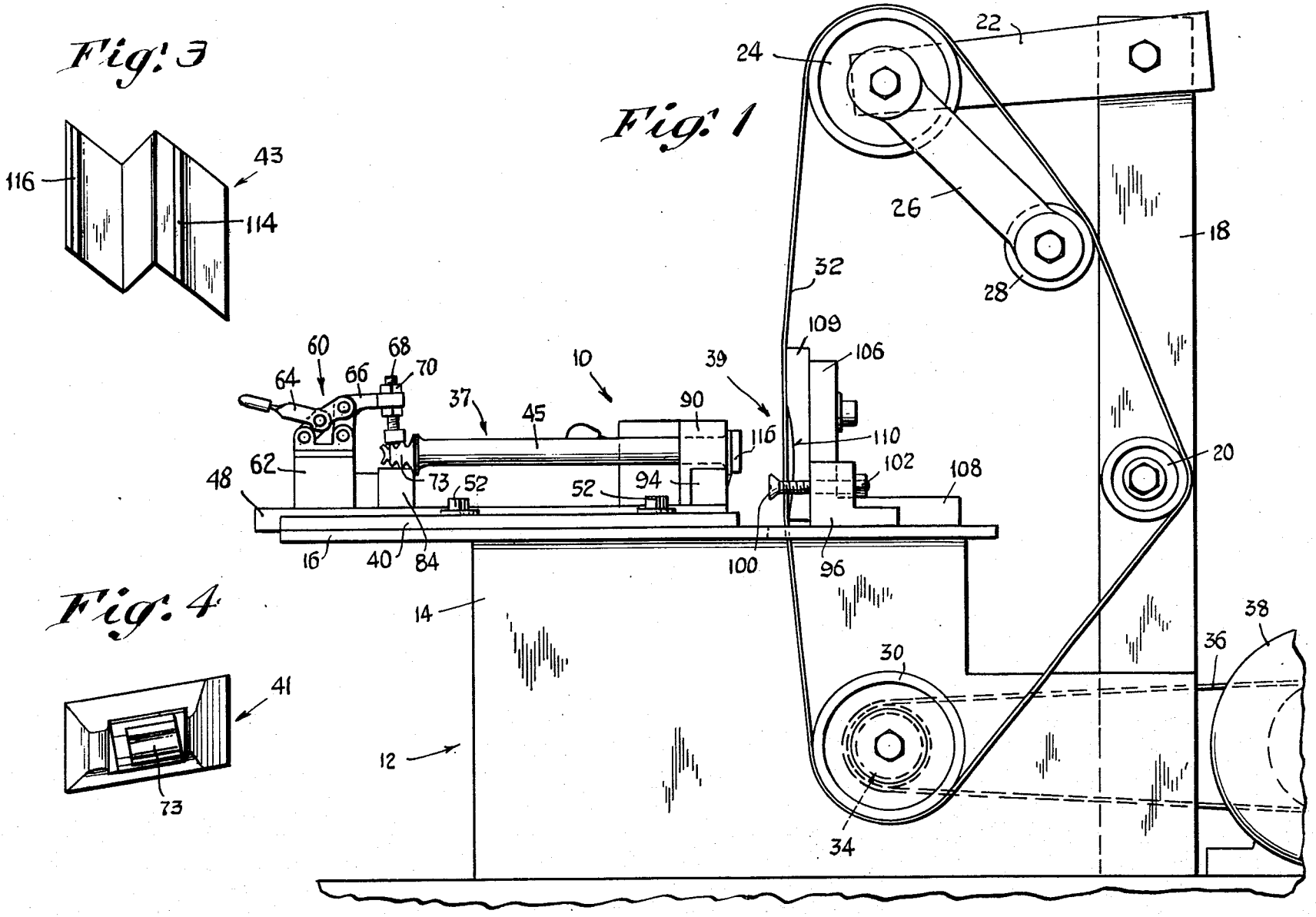
FIG. 1 is a side elevational view of the turbine blade resurfacing device of the present invention, showing a blade clamped in position on a slide and having its sealing flange portion positioned for movement into engagement with the abrasive belt.
FIG. 3 is a right-end elevational view of a turbine blade of the type adapted to be contoured by the resurfacing machine of the present invention.
FIG. 4 is a left-end elevational view of the turbine blade of FIG. 3.
Figure 2:
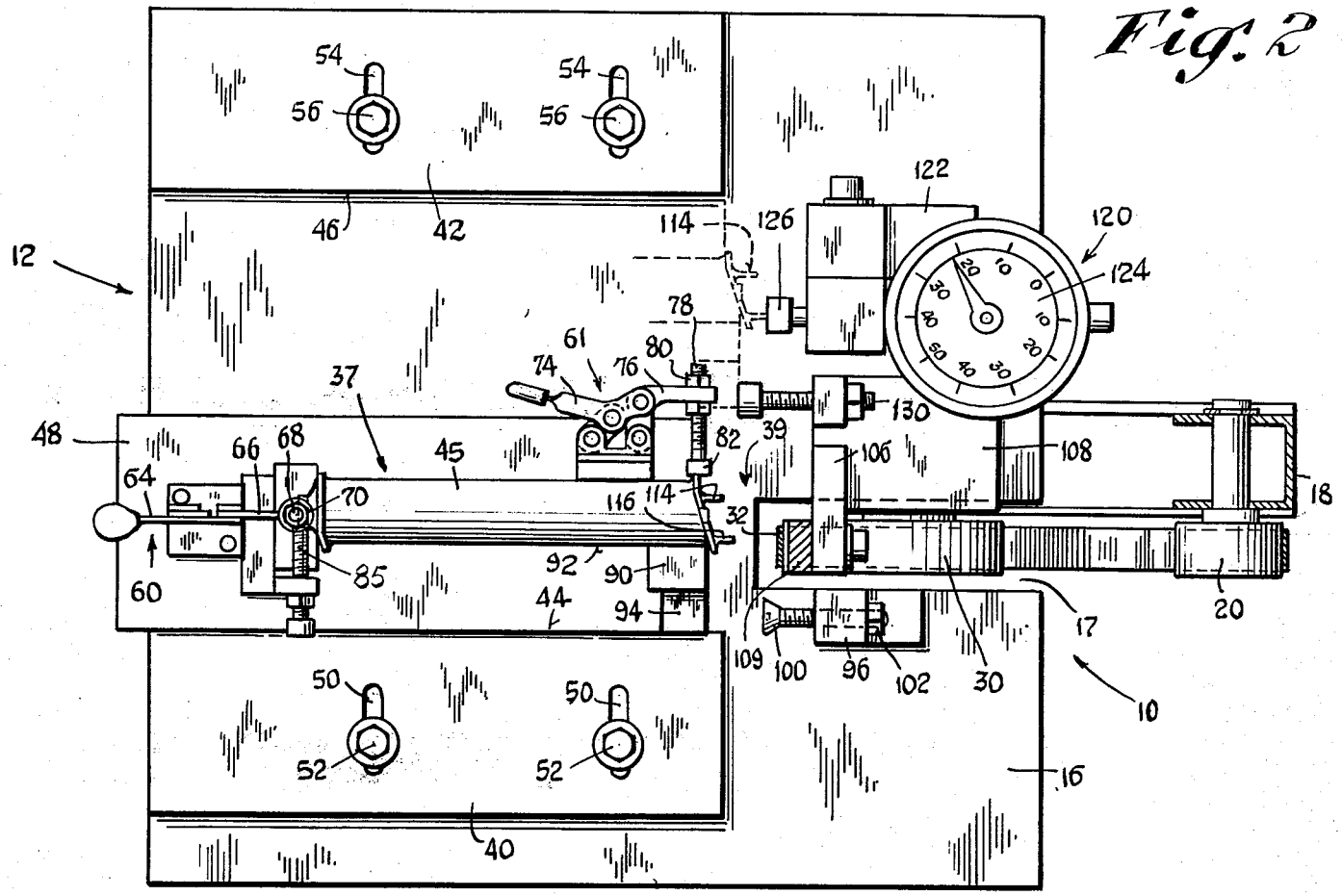
FIG. 2 is a top plan view of the turbine blade refinishing machine of FIG. 1.

Referring to FIGS. 1 and 2 there is illustrated a resurfacing machine generally indicated by the numeral 10, comprising a bench or base 12 having side plates 14 and a top plate 16. The top plate 16 is provided with a slot or well 17 which extends to a work-performing station identified below. Carried by one of the side plates 14 is an upright support member constituted as a channel 18, having a pulley 20 and an over-arm 22, the latter carrying an additional pulley 24. Also carried by the over-arm 22 is a tension arm 26 having a take-up idler pulley 28. In addition, a drive pulley 30 is carried by the base 12, and an abrasive belt 32 is installed around the pulleys 20, 24, 28, and 30, the outer surface of the belt 32 having cutting grits or other abrasive material adhered thereto. Attached to the shaft having the pulley 30 is an additional pulley 34, and a drive belt 36 extends therefrom to a drive motor 38. The arrangement is such that the cutting belt 32 is maintained in tension by the idler pulley 28, with drive power to the belt being provided by the motor 38. The above-described pulleys constitute a means for driving the belt 32 through a well in the base 12 and past a work-performing station as explained below.

In accordance with the present invention there are provided unique mounting means carried by the base 12 for advancing a turbine blade 37 on a work-performing station indicated generally by the numeral 39, and for removing controlled amounts of end portions of the turbine blade air seal by means of an abrading operation utilizing the belt 32. Referring to FIG. 2, the top plate 16 of the bench or base 12 carries a pair of guide plates 40, 42 which have longitudinal edges 44,

46 facing one another, adapted to selectively engage the opposite longitudinal edges of a slide 48. As shown, the lower guide plate 40 has a pair of slots 50, and draft screws 52 extend through the slots 50 and into the top plate 16 in order to enable adjustment of the position of the plate 40 with respect to the work-performing station 39. Similarly, the other guide plate 42 has slots 54 receiving screws 56, to enable adjustment in the position with respect to a gauge or indicator described below.

Referring again to FIG. 2, it can be seen that the slide 48 carries a pair of toggle clamps 60, 61 which can be substantially identical with respect to one another. The clamp 60 is mounted on a support block 62 which in turn is secured to the slide 48. The clamp 60 is of the type which includes an acutator arm 64 and a pivot arm 66, the latter carrying a clamp jaw in the form of a screw 68 locked to the arm 66 by a pair of nuts 70. Disposed at the end of the jaw 68 is a rubber abutment face 72 which is adapted to engage a mounting base portion 73 of the turbine blade 37 to be resurfaced, as will be explained below. Similarly, the clamp 61 includes an actuator arm 74 and a pivot arm 76, the latter carrying a clamp jaw in the form of a screw 78 secured by means of locking nuts 80. Carried at the end of the clamp jaw 78 is a rubber abutment face 82.

Referring again to FIG. 1 there is provided on the slide 48 a clamp block 84 and screw 85 adapted to support one end of the turbine blade 37, together with the rubber abutment face 72. Similarly, in FIG. 2, there is provided an additional clamp block 90 which is adapted to engage a longitudinal edge portion 92 of the turbine blade 37, so as to provide a back up for the clamp jaw abutment face 82.

In accordance with the present invention, adjustable stop means are provided, carried on the slide 48 and on the base 16 for limiting the advancing movement of the slide (and turbine blade) toward the belt 32. This means comprises a stop or abutment 94 on the slide, and a mounting or block 96 carried on the top plate 16 of the base. As shown in FIGS. 1 and 2, the block 96 carries a stop member in the form of a screw 100 together with a locking nut 102 for securing the screw in predetermined affixed positions. The head of the screw is adapted to be engaged by the stop or abutment 94 as the slide 48 is moved toward the right in FIGS. 1 and 2.

Also in accordance with the present invention, there is carried by the top plate 16 an upstanding support post 106 which has a base 108 secured by suitable screws. The post 106 in turn mounts a contoured member or back-up shoe 109 having a concave or contour surface 110 shown as having a slight curvature or large radius. The area located immediately in front of the contoured surface 110 in FIG. 1 is hereinafter referred to as a work-performing zone.

A typical turbine blade 37 of the type adapted to be resurfaced by the improved resurfacing machine of the present invention is illustrated in the figures. In FIG. 4, the inner or mounting end 41 of the turbine blade is shown, comprising a mounting base 73 constituted as a ribbed projection, and in FIG. 3 the outer blade end 43 is illustrated, having a pair of transverse seal flanges designated by the numerals 114, 116. These flanges are also illustrated in FIG. 2. The body portion 45 of the turbine blade 37 is contoured as an intersection of two curved surfaces, somewhat similar to the cross-sectional configuration of an airplane wing.

The operation of the improved resurfacing machine of the present invention may now be understood by referring to FIGS. 1 and 2. The turbine blade 37 is shown as being clamped in place with its concave side facing downward when viewed in FIG. 1. The clamping is accomplished by actuation of the toggle actuator arm 64, which brings the abutment face 72 into firm engagement with the mounting base 73 of the blade, together with actuation of the toggle arm 74 to bring the rubber abutment piece 82 into engagement with the upper edge of the turbine blade as viewed in FIG. 2. The clamp block 90 thus constitutes a stationary jaw cooperable with the jaw formed by the screw 78 and rubber abutment face 82. Considering the slide 48 in the position illustrated in FIG. 2, and with the belt 32 driven by the motor 38 it will be seen that as the slide is advanced toward the right, the end surface of the seal flange 116 will be brought into engagement with the belt. As this is done, the belt, being somewhat yieldable, will be urged inwardly so as to partially occupy the contour surface 110 of the back-up shoe 109. As a result, the grinding of the end seal 116 which occurs is not along a straight line. Instead, it tends to assume a curved shape which is governed by the particular configuration of the contour surface 110. As the slide is progressively moved or advanced toward the right, the stop or abutment 90 will be engaged by the head 100 of the adjustable stop screw. This will effectively limit the rightward movement of the slide to a predetermined amount, thus limiting the amount of grinding of the seal flange 116 which occurs.

Preferably, during the grinding or abrading process, it is desirable to check the dimension of the flange 116 in order to insure that only the proper predetermined amount of material is taken off. Means are provided for accomplishing this, including an indicator device 120 which is secured to the upper top plate 16 by means of an indicator mount 122. The indicator 120 includes a gauge 124 having a feeler arm 126 adapted to be engaged by the air seal flange 116 when the slide 48 is positioned to engage the guide plate 42 and then advanced. Such a position is illustrated in broken lines in FIG. 2, wherein the flange 116 is shown engaging the feeler 126. In addition, adjustable stop structures are provided for limiting the movement of the slide during its engagement with the guide plate 42, the stop structures comprising a stop consisting of a screw mounting block 128 carrying an adjustable screw 130 which is secured by means of a locknut 132. The head of the stop or screw 130 is adapted to be engaged by the stop or abutment 94 on the slide 48 as the latter is moved toward the right in FIG. 2. During such engagement the feeler 126 will yield a certain amount, according to the dimensions of the flange 116, and these dimensions will be indicated by the reading on the gauge 124.

During the refinishing process, assuming that too little material has been removed as indicated by the indicator reading, the slide block 48 can be returned to its position of engagement with the guide plate 40 and an additional can be made to insure that the stops 94, 100 are firmly engaged. Following such additional procedure the slide plate 48 can be easily again shifted to the gauging position, engaging the upper guide plate 42 in order to again check the dimensions of the flange 116. The process can be repeated, of course, until the proper reading is obtained on the indicator 124. However, it will be found necessary mostly to check the wear of the belt 32.

It will be seen that due to the unique mounting arrangement of the turbine blade on the slide 48, removal of the blade is not required each time it is desired to check the dimensions of the flange 116 or check for belt wear. Instead, the slide 48 is merely moved from engagement with the guide plate 40 to the other guide plate 42. As a result, greatly simplified operation is achieved, with a minimum of wasted time. In addition, slight misalignment of the turbine blade with respect to the slide 48 which might possibly occur if the blade had to be removed and reclamped, is eliminated. The setting-up of the machine is greatly facilitated by means of the adjustable stop screws 100 and 130, utilizing for example a master or new blade against the indicator feeler 126. Once a blade having the proper characteristics is obtained by means of the above grinding process, a resurfacing of subsequent blades is greatly simplified, involving only the removal of the properly resurfaced blade and the installation of the next unfinished blade.

By virture of the provision of the slots 50, 54 in the guide plates 40, 42, adjustment of the plate positions can be readily obtained. This also enables the subsequent grinding of the second air seal flange 114. Such operation is accomplished by merely loosening the screws 52, 56 and sliding the guide plates 40, 42 downward as viewed in FIG. 2, so that the flange 114 will be in alignment with the center of the belt 32. Thereafter the screws are retightened. In addition, slight re-adjustment of the stop screws 100 and 130 will have to be made, in order to effect refinishing of the second flange 114, as is understood.

From the above it can be seen that I have provided a novel and improved turbine blade resurfacing machine which is extremely simple in its construction, reliable in operation, and which provides a satisfactory solution to the problem of mass restoring of large numbers of substantially identical turbine blades. The machine eliminates errors due to operator judgement, and as a result it greatly improves the uniformity and quality of restored blades. The invention thus represents a distinct advance and improvement in the technology of reclaiming of worn turbine blades.

Variations and modifications are possible without departing from the spirit of the invention.

I claim:

1. A machine for refinishing the end edges of air seal flanges which are located at the extremities of turbine blades and which have been resurfaced by welding, comprising in combination:

a. a stationary base, b. a contoured back-up shoe affixed to the base at a work-performing station thereon and having a contoured surface fixedly disposed in a work-performing zone, c. an abrasive belt having a surface provided with cutting particles, d. means for driving said belt over the back-up shoe with the back of the belt engageable with the shoe, said belt being capable of yielding upon said engagement and conforming to the shape of the contoured surface, e. a slide movable over the base toward and away from said shoe at the work-performing station, f. a clamping device carried by the slide, adapted to clamp a turbine blade so as to enable the slide to present the resurfaced seal flange of the blade to the cutting belt to be resurfaced thereby, said slide including means for positioning the blade at a predetermined fixed elevation above the base in said work-performing zone, and g. cooperable adjustable stop means including a stop member on the base, for limiting the advancing movement of the turbine blade on the belt, thereby to establish the amount of flange required to be retained on the blade after the resurfacing thereof.

2. A machine as in claim 1, and further including cooperable guide means on the base and slide, to guide the latter in the advancing movement.

3. A machine as in claim 1, and further including:

a. an indicator carried by the base, said indicator having a feeler, and b. cooperable guide structures on said base and slide, to guide the latter for advancing movement toward the indicator whereby the resurfaced flange of the turbine blade can be engaged with the indicator feeler to check the resurfacing operation.

4. A machine as in claim 3, and further including:

a. cooperable adjustable stop structures including a stop rigid with the base, for limiting the advancing movement of the slide toward the indicator so as to enable the latter to provide a reading of the resurfaced flange edge.

5. A machine as in claim 4, wherein:

a. the means for driving the belt comprises a plurality of pulleys around and over which the belt passes, including one pulley above the base and one pulley below the base, b. said base having a well at the work-performing station, through which the belt extends in passing over said pulleys.

6. A machine as in claim 4, wherein:

a. the back-up shoe comprises a member extending upward from the base and having a concave surface facing the back of the belt.

7. A machine as in claim 1, wherein:

a. the stop means comprises an abutment on the slide, engageable with the stop member of the base.

8. A machine as in claim 7, wherein:

a. the stop member of the base comprises an adjusting screw.

9. A machine as in claim 4, wherein:

a. the stop means comprises an abutment on the slide, engageable with the stop member of the base, b. said stop structures including the said abutment on the slide.

10. A machine as in claim 9, wherein:

a. the stop member and stop on the base comprise adjusting screws.

* * * * *